US008870290B2

(12) United States Patent
Xu

(10) Patent No.: US 8,870,290 B2
(45) Date of Patent: Oct. 28, 2014

(54) NAPOLEONIC CHAIR

(75) Inventor: Jianye Xu, Zhejiang (CN)

(73) Assignee: Cixi Leye Seating Factory (General Partner), Zhejiang (CN)

( * ) Notice: Subject to any disclaimer, the term of this patent is extended or adjusted under 35 U.S.C. 154(b) by 0 days.

(21) Appl. No.: 14/008,044

(22) PCT Filed: May 31, 2011

(86) PCT No.: PCT/CN2011/074940

§ 371 (c)(1),
(2), (4) Date: Sep. 27, 2013

(87) PCT Pub. No.: WO2012/129838

PCT Pub. Date: Oct. 4, 2012

(65) Prior Publication Data

US 2014/0015298 A1 Jan. 16, 2014

(30) Foreign Application Priority Data

Mar. 30, 2011 (CN) ..... 2011 2 0089427 U

(51) Int. Cl.
*A47C 5/12* (2006.01)
*A47C 4/02* (2006.01)

(52) U.S. Cl.
CPC . *A47C 4/02* (2013.01); *A47C 4/022* (2013.01); *A47C 5/12* (2013.01)
USPC ..... 297/440.18; 297/440.24

(58) Field of Classification Search
CPC ..... A47C 5/12
USPC ..... 297/440.18, 440.24
See application file for complete search history.

(56) References Cited

U.S. PATENT DOCUMENTS

| | | | | |
|---|---|---|---|---|
| 5,536,063 | A | 7/1996 | Cable | |
| 5,988,755 | A * | 11/1999 | Fastelli et al. | 297/440.24 |
| 2004/0041455 | A1 | 3/2004 | Tenbroeck et al. | |
| 2009/0072599 | A1 * | 3/2009 | Xu | 297/446.1 X |

FOREIGN PATENT DOCUMENTS

| | | | |
|---|---|---|---|
| CN | 201082038 | Y | 7/2008 |
| CN | 201286497 | Y | 8/2009 |
| CN | 201384262 | Y | 1/2010 |

* cited by examiner

*Primary Examiner* — Anthony D Barfield
(74) *Attorney, Agent, or Firm* — Blank Rome LLP

(57) ABSTRACT

A Napoleonic chair includes a plastic seat plate, front chair legs, rear chair legs, connecting rods between front and rear chair legs, and a plastic back. The front chair legs comprise front chair leg mounting elements composed of steel tube and plastic casing tubes which sleeve the periphery of the front chair leg mounting elements, while the rear chair legs comprise rear chair leg mounting elements composed of steel tube and plastic casing tubes which sleeve the periphery of the rear chair leg mounting elements. The connecting rods between front and rear chair legs include a steel tube and a plastic casing tube which sleeves the periphery of the steel tube. One end of each longitudinal pipe of the rear chair leg mounting elements is inserted into the plastic back. Two ends of the steel tubes of the rods are inserted into the plastic tubes of the front and rear chair legs, respectively. Plastic blocks are arranged between two longitudinal pipes of both front and rear leg mounting elements, so that the plastic seat plate is stuck on the plastic blocks.

6 Claims, 2 Drawing Sheets

NAPOLEONIC CHAIR

CROSS-REFERENCE TO RELATED APPLICATIONS

This application is a National Phase of Application No. PCT/CN2011/074940 filed May 31, 2011, which claims the benefit of priority to Chinese Patent Application No. 201120089427.5 titled "NAPOLEON CHAIR", filed with the Chinese State Intellectual Property on Mar. 30, 2011. The entire disclosures thereof are incorported herein by reference.

FIELD OF THE INVENTION

The present application relates to the technical field of chair, and particularly relates to a Napoleon chair.

BACKGROUND OF THE INVENTION

A conventional Napoleon chair is usually made of wood material. In using, the Napoleon chair may be rocked front and back, which may cause a frail structure and a short service life. Moreover, if the wooden Napoleon chair is broken and can no longer be used, the material thereof will be wasted.

SUMMARY OF THE INVENTION

In view of this, the present application provides a Napoleon chair to solve the problems that the conventional Napoleon chair may be rocked front and back in using and has a short service life, and the material thereof is wasted.

For solving the above problem, the present application provides a technical solution as follows.

A Napoleon chair includes a plastic seat plate, a front chair leg, a rear chair leg, a connecting rod for the front chair leg and the rear chair leg, and a plastic backrest, wherein, the front chair leg includes a front-chair-leg frame consisted of a steel tube and a plastic sleeve sleeved outside the front-chair-leg frame, the rear chair leg includes a rear-chair-leg frame consisted of a steel tube and a plastic sleeve sleeved outside the rear-chair-leg frame, and the connecting rod for the front chair leg and the rear chair leg includes a steel tube and a plastic sleeve sleeved outside the steel tube;

the rear-chair-leg frame includes two longitudinal tubes, one end of both the two longitudinal tubes is inserted into the plastic backrest; and the steel tube of the connecting rod for the front chair leg and the rear chair leg includes two end inserted into the plastic sleeve of the front chair leg and the plastic sleeve of the rear chair leg, respectively; and a plastic connecting member is provided between two longitudinal tubes of the front-chair-leg frame as well as between the two longitudinal tubes of the rear-chair-leg frame, and the plastic seat plate and the plastic connecting members are connected in a snap fit manner.

Preferably, the plastic backrest is provided with a plurality of hollow protrusions, a longitudinal rod is mounted on a protrusion of the plastic sleeve sleeved outside a first lateral rod of the rear-chair-leg frame, and the other end of the longitudinal rod is mounted in the plurality of hollow protrusions on the plastic backrest.

Preferably, the longitudinal rod includes a steel tube and a plastic sleeve sleeved outside the steel tube.

Preferably, the longitudinal rod is a plastic sleeve.

Preferably, the plastic seat plate and the plastic connecting member of the front chair leg are connected via a screw.

Preferably, the plastic seat plate and the plastic connecting member of the rear chair leg are connected via a screw.

From the above technical solution, it can be seen that in the Napoleon chair according to the present application, the front chair leg, the rear chair leg and the connecting rod for the front chair leg and the rear chair leg each have a double-layer structure which has an inner part consisted of a steel tube and a plastic sleeve sleeved outside the inner part, such that the stability of the chair is improved and the service life of the chair is prolonged. Furthermore, in the Napoleon chair, the seat plate, the backrest and each of the sleeves are all made of plastic, and the steel tubes are recyclable, thereby further solving the problem of material waste of the conventional Napoleon chair.

BRIEF DESCRIPTION OF THE DRAWINGS

For more clearly illustrating embodiments of the present application or the technical solution in the prior art, drawings referred to describe the embodiments or the prior art will be briefly described hereinafter. Apparently, the drawings in the following description are only several embodiments of the present application, and for the person skilled in the art other drawings may be obtained based on these drawings without any creative efforts.

DETAILED DESCRIPTION OF THE EMBODIMENTS

The technical solutions in the embodiments of the present application will be described clearly and completely hereinafter in conjunction with the drawings in the embodiments of the present application. Apparently, the described embodiments are only a part of the embodiments of the present application, rather than all embodiments. Based on the embodiments in the present application, all of other embodiments, made by the person skilled in the art without any creative efforts, fall into the protection scope of the present application.

The present application provides a Napoleon chair to solve problems that the conventional Napoleon chair has a short service life and wastes material.

Figure 1:
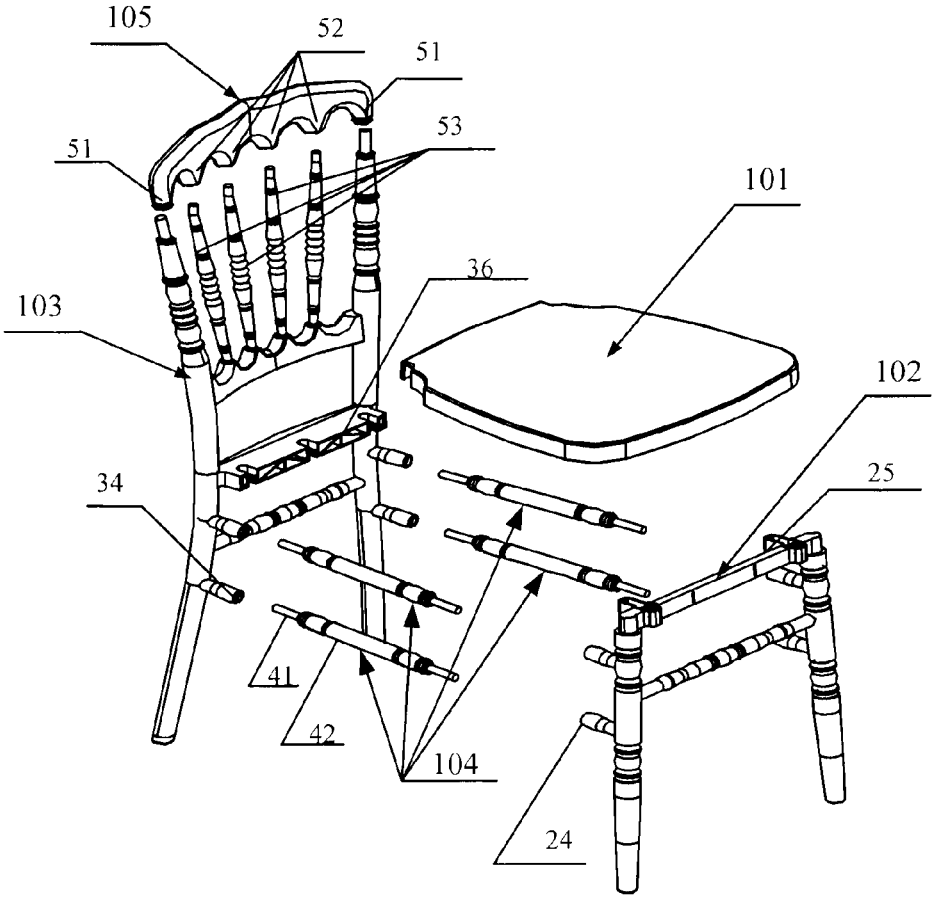
FIG. 1 is an exploded view showing the structure of a Napoleon chair according to an embodiment of the present application.
Figure 2:
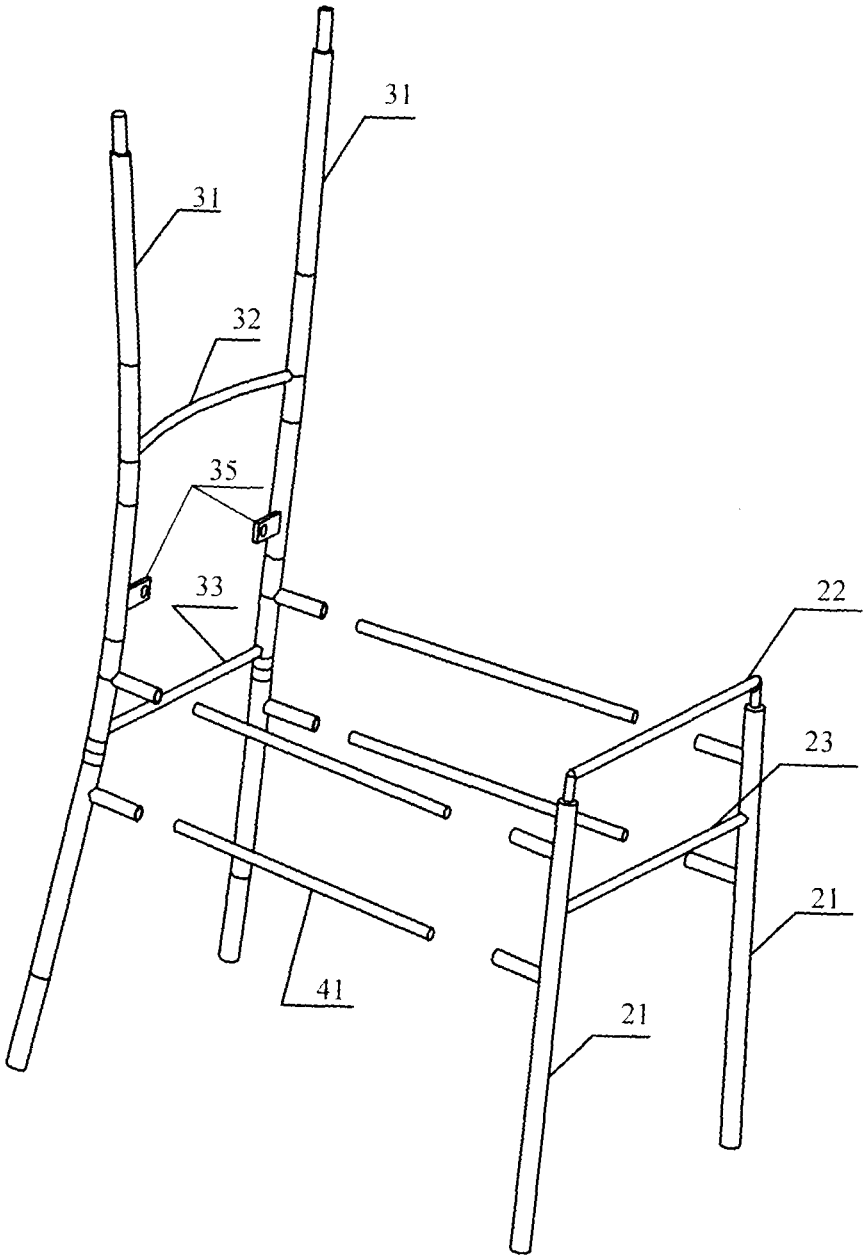
FIG. 2 is a schematic view showing the structure of a front chair leg, a rear chair leg and a connecting rod for the front chair leg and the rear chair leg, which are all consisted of a steel tube, according to an embodiment of the present application.

As shown in FIG. 1, the Napoleon chair according to the present embodiment includes a plastic seat plate 101, a front chair leg 102, a rear chair leg 103, a connecting rod 104 for the front chair leg and the rear chair leg, and a plastic backrest 105. Reference is made to FIG. 2, which is schematic view showing the structure of the front chair leg, the rear chair leg and the connecting rod for the front chair leg and the rear chair leg, which are all consisted of a steel tube, according to the present embodiment.

The front chair leg 102 includes a front-chair-leg frame consisted of steel tubes and a plastic sleeve sleeved outside the front-chair-leg frame. The front-chair-leg frame includes two longitudinal tubes 21, a first lateral rod 22 connected between top ends of the two longitudinal tubes 21, and a second lateral rod 23 located below the first lateral rod 22 and connected to the two longitudinal rods 21.

The rear chair leg 103 includes a rear-chair-leg frame consisted of steel tubes and a plastic sleeve sleeved outside the rear-chair-leg frame. The rear-chair-leg frame includes two longitudinal tubes 31, a first lateral rod 32 and a second lateral rod 33. Two ends of both the first lateral rod 32 and the second lateral rod 33 are connected to the two longitudinal rods 31, respectively.

The connecting rod 104 for the front chair leg and the rear chair leg includes a steel tube 41 and a plastic sleeve 42 sleeved outside the steel tube 41.

Furthermore, the plastic backrest 105 is provided with two hollow protrusions 51. One end of each of the two longitudinal tubes 31 of the rear-chair-leg frame is inserted into the corresponding hollow protrusion 51 of the plastic backrest 105 to connect the rear-chair-leg frame with the plastic backrest 105.

Two ends of the steel tube 41 of the connecting rod 104 for the front chair leg and the rear chair leg are respectively inserted into a plastic sleeve 24 of the front chair leg 102 and a plastic sleeve 34 of the rear chair leg 103 so as to connect the front chair leg 102 to the rear chair leg 103.

A plastic connecting member 25 is sleeved outside the first lateral rod 22 of the front chair leg 102. The two longitudinal tubes 31 of the rear chair leg 103 are both provided with a connecting handle 35 at a corresponding position. A plastic connecting member 36 is connected between two connecting handles 35. The plastic seat plate 101 is provided, at a bottom surface, with grooves corresponding to the plastic connecting member 25 and the plastic connecting member 36. The plastic seat plate 101 and the two plastic connecting members are connected in a snap fit manner.

In the Napoleon chair according to the present embodiment, the front chair leg 102, the rear chair leg 103 and the connecting rod 104 for the front chair leg and the rear chair leg each have a double-layer structure which has an inner part consisted of a steel tube, and a plastic sleeve sleeved outside the inner part, such that the stability of the chair is improved and the service life of the chair is prolonged. Furthermore, in the Napoleon chair, the seat plate 101, the backrest 105 and each of the sleeves are all made of plastic, and the steel tubes are recyclable, thereby further solving the problem of material waste of the conventional Napoleon chair.

In order to improve the comfortableness of the Napoleon chair, also as shown in FIG. 1, the plastic backrest 105 is further provided with multiple hollow protrusions 52, and preferably is provided with four hollow protrusions. And, the plastic sleeve arranged outside the first lateral rod 32 of the rear chair leg 103 is also provided with multiple hollow protrusions, and preferably is also provided with four hollow protrusions. A longitudinal rod 53 is mounted between the hollow protrusion of the plastic backrest 105 and the corresponding hollow protrusion of the plastic sleeve outside the first lateral rod 32.

Specifically, the longitudinal rod 53 includes a steel rube and a plastic sleeve sleeved outside the steel tube. The longitudinal rod 53 may just include a plastic sleeve with no steel tube provided inside.

Of course, in order to facilitate manufacture, the four longitudinal rods 53, and the plastic sleeve outside the first lateral rod 32 of the rear chair leg 103 can be made integrally. In this case, the mounting process can be achieved by sleeving the plastic sleeve on the first lateral rod 32 of the rear chair leg 103 and then inserting the four longitudinal rods 53 into the hollow protrusions 52 on the plastic backrest 105 respectively.

In order to enhance the stability of the connection between the plastic seat plate 101 and the front chair leg 102, and the connection between the plastic seat plate 101 and the rear chair leg 103, the plastic seat plate 101 and the plastic connecting member 25 of the front chair leg are further connected by a screw, and the plastic seat plate 101 and the plastic connecting member 36 of the rear chair leg are further connected by a screw.

The above embodiments are described in a progressive manner. Each of the embodiments is mainly focused on describing its differences from other embodiments, and references may be made among these embodiments with respect to the same or similar portions among these embodiments.

Based on the above description of the above embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. A Napoleon chair, comprising: a plastic seat plate, a front chair leg, a rear chair leg, at least two connecting rods for the front chair leg and the rear chair leg, and a plastic backrest, wherein, the front chair leg is a double-layer structure and comprises a front-chair-leg frame consisting of a steel tube and a plastic sleeve disposed outside the front-chair-leg frame, the front-chair-leg frame comprising two longitudinal tubes, and at least two lateral rods connected between the two longitudinal tubes, each of the longitudinal tubes and the lateral rods of the front-chair-leg frame being a steel tube, and a plastic sleeve disposed outside each of the longitudinal tubes and the lateral rods of the front-chair-leg frame, the rear chair leg being of a double-layer structure and comprising a rear-chair-leg frame consisting of a steel tube and a plastic sleeve disposed outside the rear-chair-leg frame, the rear-chair-leg frame comprising two longitudinal tubes, and at least two lateral rods connected between the two longitudinal tubes, and each of the longitudinal tubes and the lateral rods of the rear-chair-leg frame being a steel tube, and a plastic sleeve disposed outside each of the longitudinal tubes and the lateral rods of the rear-chair-leg frame, and each of the connecting rods for the front chair leg and the rear chair leg comprising a steel tube and a plastic sleeve disposed outside the steel tube;

one end of both the two longitudinal tubes of the rear-chair-leg frame being inserted into the plastic backrest; and the steel tube of each of the connecting rods for the front chair leg and the rear chair leg comprising two ends inserted into the plastic sleeve disposed outside the longitudinal tube of the front chair leg and the plastic sleeve disposed outside the longitudinal tube of the rear chair leg, respectively; and a plastic connecting member being provided between the two longitudinal tubes of the front-chair-leg frame as well as the two longitudinal tubes of the rear-chair-leg frame, and the plastic seat plate and the plastic connecting members being connected in a snap fit manner.

2. The Napoleonic chair according to claim 1, wherein, the plastic backrest is provided with a plurality of hollow protrusions, and a longitudinal rod is mounted on a protrusion of the plastic sleeve disposed outside a first lateral rod of the rear-chair-leg frame, and the other end of the longitudinal rod is mounted in the plurality of hollow protrusions on the plastic backrest.

3. The Napoleonic chair according to claim 2, wherein, the longitudinal rod comprises a steel tube and a plastic sleeve disposed outside the steel tube.

4. The Napoleonic chair according to claim 2, wherein, the longitudinal rod is a plastic sleeve.

5. The Napoleonic chair according to claim 1, wherein, the plastic seat plate and the plastic connecting member of the front chair leg are further connected via a screw.

6. The Napoleonic chair according to claim 1, wherein, the plastic seat plate and the plastic connecting member of the rear chair leg are further connected via a screw.

* * * * *